US007300249B1

(12) United States Patent
Cobb

(10) Patent No.: US 7,300,249 B1
(45) Date of Patent: Nov. 27, 2007

(54) AUTOMATIC DOUBLE FOLDING HAND FANS

(76) Inventor: Susan Gail Cobb, 149 N. Maple La., Sisters, OR (US) 97759

( * ) Notice: Subject to any disclaimer, the term of this patent is extended or adjusted under 35 U.S.C. 154(b) by 0 days.

(21) Appl. No.: 11/511,829

(22) Filed: Aug. 28, 2006

Related U.S. Application Data

(62) Division of application No. 11/059,248, filed on Feb. 16, 2005, now Pat. No. 7,128,531.

(51) Int. Cl.
*A45B 27/00* (2006.01)

(52) U.S. Cl. ..... 416/73; 416/70 A

(58) Field of Classification Search ..... 416/70 A, 416/70 R, 72, 73, 77
See application file for complete search history.

(56) References Cited

U.S. PATENT DOCUMENTS

| | | | | |
|---|---|---|---|---|
| 137,413 | A * | 4/1873 | Brueck | 416/71 |
| 278,799 | A * | 6/1883 | Kinn | 416/73 |
| 323,811 | A * | 8/1885 | Hoefle | 416/73 |
| 509,835 | A * | 11/1893 | Baer | 416/73 |
| 519,554 | A * | 5/1894 | Rubin | 416/73 |
| 523,762 | A * | 7/1894 | Cwerdinski | 416/73 |

* cited by examiner

*Primary Examiner*—Edward K. Look
*Assistant Examiner*—Nathan Wiehe
(74) *Attorney, Agent, or Firm*—Kevin Roe

(57) ABSTRACT

Methods to make various types of automatically opening hand fans. One embodiment is an automatic double folding hand fan having a first guard and a second guard and spring mechanisms to open the fan.

6 Claims, 16 Drawing Sheets

AUTOMATIC DOUBLE FOLDING HAND FANS

CROSS REFERENCE TO RELATED APPLICATIONS

This application is a division of a U.S. utility patent application, Ser. No. 11/059,248, filed Feb. 16, 2005 now U.S. Pat. No. 7,128,531, entitled "Automatic Hand Fans," which is incorporated by reference.

BACKGROUND OF THE INVENTION

1. Field of the Invention

This invention relates generally to hand fans, and more specifically to providing methods to make new types of hand fans, and enhancements to, hand fans.

2. Description of the Prior Art

Hand fans have been known throughout the ages around the world. Several types of fans have been used over the years, but the most common hand fans still widely used today are the standard folding hand fan, the non-folding hand fan, and the substantially circular hand fan. These fans are typically made of fabric or paper webbing (i.e., leaves), attached to supports (i.e., ribs) on projecting sticks. The standard folding hand fan typically has two outer guards to partially protect the folded fan, leaves, and sticks.

These fans can be quite useful in cooling people in overheated conditions, such as in hot rooms and outdoors. With the advent of global warming, the use of hand fans will likely increase. Recently there has been an incremental increase in the use of standard hand fans in fashion shows and other high-level social situations. The utilitarian benefits of hand fans are returning as the paramount reason for their widespread use, as opposed to their social status statement of previous centuries.

Surprisingly, these hand fans have not changed much over the course of recent centuries. In particular, folding hand fans have continued to be made in virtually the same materials and designs over the last 200 years. However, such folding hand fans could be greatly enhanced in terms of ease of use and in available features. What is needed are folding hand fans that are more readily opened and more safely stored using new materials for fashion of the 20th and 21st centuries to increase durability while aligning to future fashion trends.

SUMMARY OF THE INVENTION

The present invention provides methods and implementations for making hand fans capable of automatic operation. Embodiments of the invention can be implemented in numerous ways. One aspect of the invention is described below.

One aspect of the invention is directed to a method to make an automatic double folding hand fan. The method includes fabricating a first guard having a corresponding first half guard and a second half guard; fabricating a second guard having a corresponding first half guard and a second half guard; attaching each first half guard, having a first end and a second end, and each second half guard, having a first end and a second end, substantially at the second end of each first half guard and the first end of each second half guard, allowing each first half guard and each second half guard to substantially rotate substantially 180 degrees around a first axis of rotation into a closed position, where the first end of each first half guard and the second end of each second half guard are in proximity, and a partially open position; installing, separately for each the first guard and the second guard, a first spring mechanism in proximity to the first axis of rotation, wherein the first spring mechanisms can selectively and substantially rotate the second half guards into the partially open position in relation to the first half guards; attaching the first half guards, having a first end and a second end, and the second half guards, having a first end and a second end, substantially at the second end of the first half guards and the first end of the second half guards, allowing the halves to substantially and jointly rotate around a first axis of rotation substantially 180 degrees into the partially open position; installing a third spring mechanism in proximity to the second axis of rotation, wherein the third spring mechanism can selectively and substantially rotate the second guard into the fully open position in relation to the first guard; and attaching a substantially planar material between a portion of the first guard and a portion of the second guard, wherein the substantially planar material can substantially fit between the first guard and second guard in the closed position, the partially open position, and the fully open position.

DETAILED DESCRIPTION OF THE PREFERRED EMBODIMENT

In all of the embodiments disclosed below, different materials could be used for the guards, the sticks, and the ribs, including but not exclusively: various metals, plastics, plexiglass, resins, papers, plant fibers, bamboo, ivory, horn, or wood. In all the embodiments disclosed below the planar material could optionally include sticks, and could optionally include solid stick and solid leaves. In all of the embodiments disclosed below, additional different materials could be used for the leaves, such as rayon, nylon, silk, Lycra, feathers, paper and other fabrics. The fabric could be made from virtually any commercially available fabric, without a design, message, or image and could optionally have a design, message, or image applied in one or more various methods not limited to batick, dies, bleaches, paint, stains, stencils, and weaves. The springs and the rivets would typically be made from some metal alloy, but could alternatively be made from other resilient materials, such as plastics, jewels, stones, and any manmade materials.

With these fans the operator retains the ability to have large designs on the fan leaves much like the old style fans, while bringing the fan into the present day with the automation of it's opening and closing and it's new materials. Various embodiments of the fan can be fabricated from bone, metal, plastic, ivory, horn, or wood sticks that are adorned or cockaded, pierced, carved, or painted or any combination of decoration. Real feathers or fake feathers could be attached to the sticks or ribs of the fan.

In one embodiment of the invention, fabric is used for the leaves, and they can be folded like the fabric of an umbrella. The fabric could be some resilient fabric, such as Lycra, nylon, or some other material that can be stretched and/or folded repeatedly without substantially losing tensile strength. In one embodiment of the invention, the sticks would fit in one half of a guard, while the leaves and the ribs would fit in the other half of a guard if the fan is double-folded.

In an alternative embodiment of the invention, the sticks themselves could also be the leaves. Some embodiments have leaves with no gap near the guards, with the ribs physically supporting the leaves. However, in an alternative embodiment of the invention, a plurality of sticks with a corresponding plurality of ribs supporting planar leaves made of some foldable material discussed above could also apply.

Figure 1A:
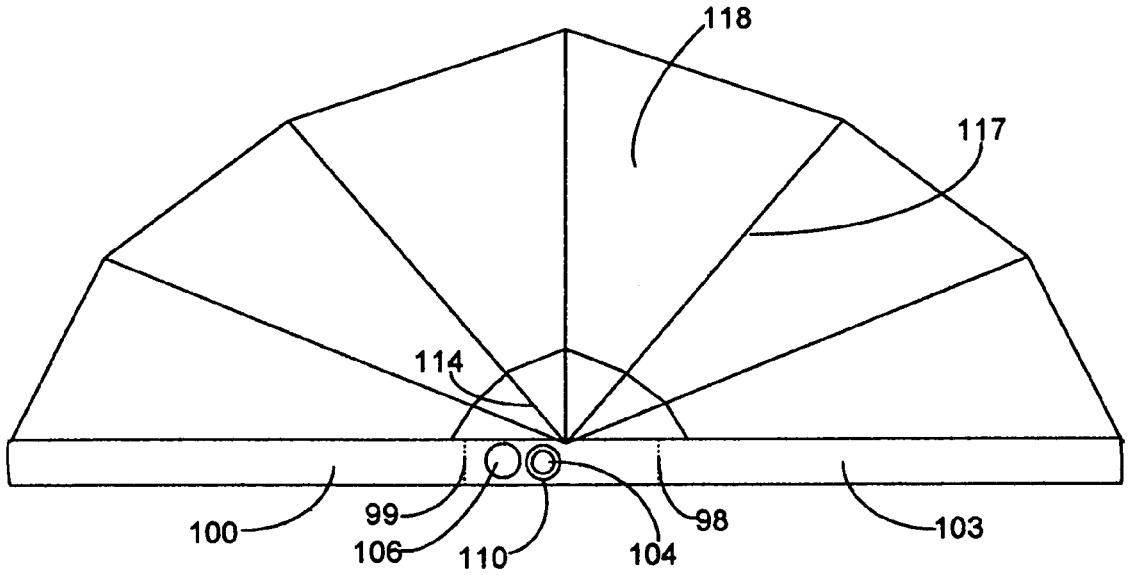
FIG. 1A illustrates a fully opened automatic compact hand fan, in accordance with one embodiment of the invention.

FIG. 1A illustrates a side view of a fully opened automatic compact hand fan, in accordance with one embodiment of the invention. The fan includes a first guard 100 and a second guard (not shown), a third guard 103, a rivet 104, an activation device 106, such as a button or stud, a spring mechanism 110, a plurality of sticks 114 with corresponding ribs 117 physically supporting a plurality of leaves 118. Guard end 98 indicates the end of guard 100, and guard end 99 indicates the end of guard 103. The guard ends 98 and 99 overlap each other when the fan is opened.

Figure 1B:
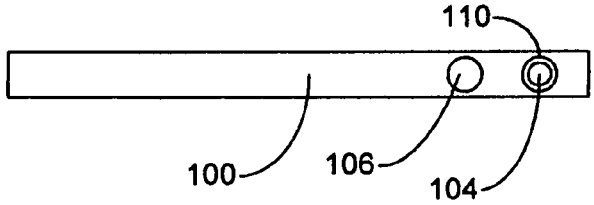
FIG. 1B illustrates a closed automatic compact hand fan, in accordance with one embodiment of the invention.

FIG. 1B illustrates a side view of a closed automatic compact hand fan, in accordance with one embodiment of the invention. Here, only the first guard 100, the rivet 104, the activation device 106, and the spring mechanism 110 are visible in this view.

Figure 1C:
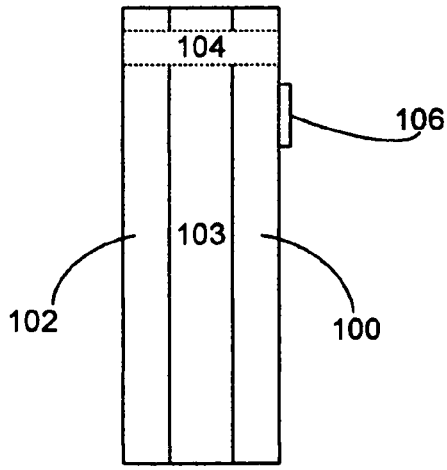
FIG. 1C illustrates an edge view of a closed automatic compact hand fan, in accordance with one embodiment of the invention.

FIG. 1C illustrates an edge view of a closed automatic compact hand fan, in accordance with one embodiment of the invention. Here, the first guard 100, the second guard 102, the third guard 103, the rivet 104, and the activation device 106 are visible in this view.

Figure 2A:
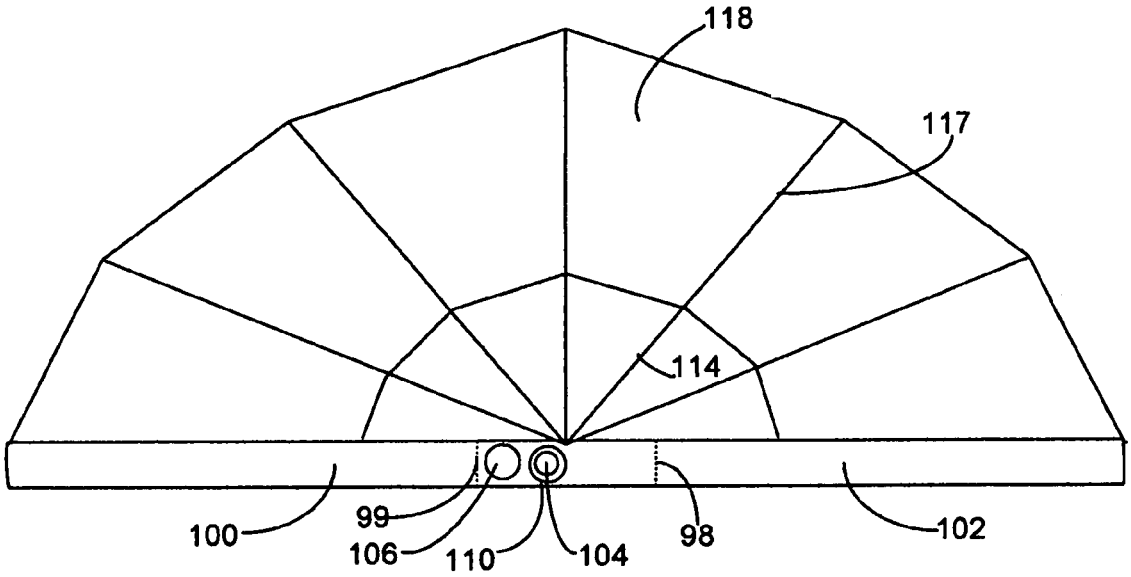
FIG. 2A illustrates a fully opened automatic standard hand fan with an automatic latch, in accordance with one embodiment of the invention.

FIG. 2A illustrates a fully opened automatic standard hand fan with an automatic latch, in accordance with one embodiment of the invention. The fan includes a first guard 100 and a second guard 102, a rivet 104, an activation device 106, such as a button or stud, a spring mechanism 110, a plurality of sticks 114 with corresponding ribs 117 physically supporting a plurality of leaves 118. Guard end 98 indicates the end of guard 100, and guard end 99 indicates the end of guard 102. The guard ends 98 and 99 overlap each other when the fan is opened. The automatic latch, the second activation device, and the second spring are not shown in this view.

Figure 2B:
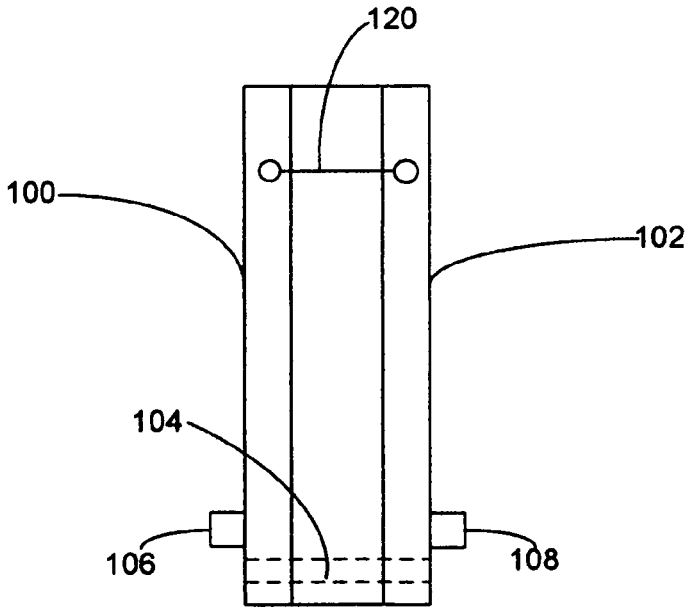
FIG. 2B illustrates a side view of a closed automatic standard hand fan with an automatic latch, in accordance with one embodiment of the invention.

FIG. 2B illustrates a side view of a closed automatic standard hand fan with an automatic latch, in accordance with one embodiment of the invention. The fan includes a first guard 100 and a second guard 102, a rivet 104, a first activation device 106, such as a button or stud, a second activation device 108, such as a button or stud, and an automatic latch 120.

The embodiment shown in FIGS. 2A and 2B appears much as a standard hand fan in length and breadth, except the guards 100 and 102 are a little thicker due to the mechanization for opening and closing the fan, and for keeping the fan closed with a safety latch 120. In one embodiment the operator can press an activation device 106 once to open the fan and then once again to close the fan. In another embodiment the operator can press one activation device 106 to open the fan, and press another activation device 108 to turn on a miniature motor to close the fan.

Figure 3A:
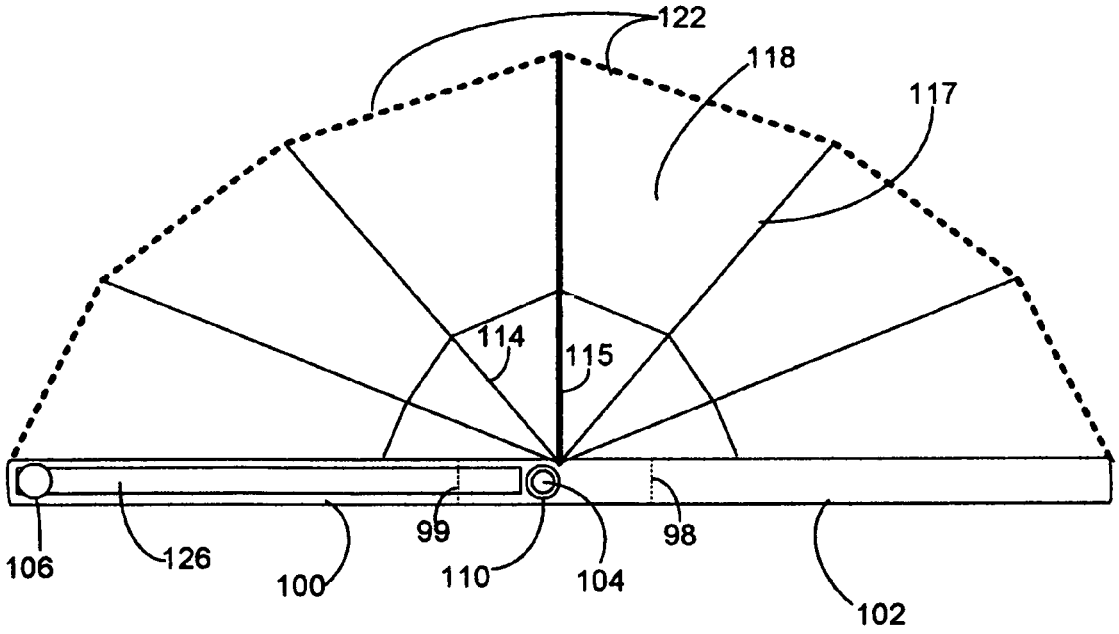
FIG. 3A illustrates a fully opened automatic sliding hand fan, in accordance with one embodiment of the invention.

FIG. 3A illustrates a fully opened automatic sliding hand fan, in accordance with one embodiment of the invention. The fan includes a first guard 100 and a second guard 102, a rivet 104, one or more spring mechanism(s) 110, an activation device 106, such as a bead, button, or stud, sliding in a groove 126, a plurality of sticks 114 (including a sturdy and stable central stick 115) with corresponding ribs 117 physically supporting a plurality of leaves 118, and one or more connectors (e.g., wires, chains, cords, or equivalents) 122. Guard end 98 indicates the end of guard 100, and guard end 99 indicates the end of guard 102. The guard ends 98 and 99 overlap each other when the fan is opened.

The embodiment shown in FIG. 3A is a fan that will automatically open via a release of an activation device 106 (e.g., bead, button, stud, or an equivalent) in a groove 126 in first guard 100, and will close via the sliding of the activation device 106 back into a fixed place on the groove 126. In alternative embodiments, the fan could be closed with a miniature motor, or by one or more additional springs, within the guards 100 or 102.

The fan appears as a conventional hand fan, except for one or more connectors 122 connecting the fan ribs 117. Both guards 100 and 102 rotate from the central stick 115. A spring mechanism (e.g., one or more spring(s) 110), coupled to central stick 115, opens the fan when the activation device 106 is released from a restraint (e.g., a clip or notch) next to groove 126.

Figure 3B:
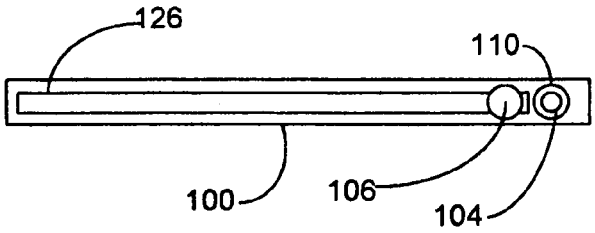
FIG. 3B illustrates a closed automatic sliding hand fan, in accordance with one embodiment of the invention.

FIG. 3B illustrates a closed automatic sliding hand fan, in accordance with one embodiment of the invention. This view shows the first guard 100, a rivet 104, a spring mechanism 110, and an activation device 106, sliding in a groove 126. The connectors 122 are not shown.

Figure 3C:
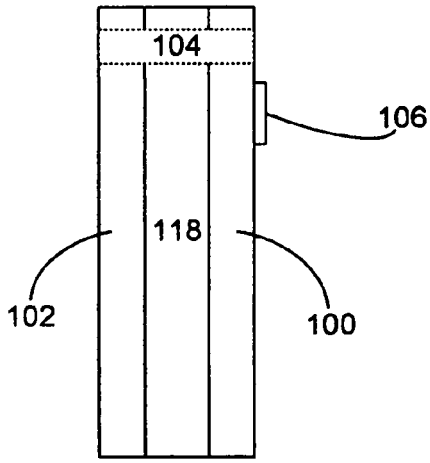
FIG. 3C illustrates an edge view of a closed automatic sliding hand fan, in accordance with one embodiment of the invention.

FIG. 3C illustrates an edge view of a closed automatic hand fan, in accordance with one embodiment of the invention. This view shows the first guard 100, the second guard 102, a rivet 104, the substantially planar material 118, and an activation device 106. The connectors 122 are not shown.

Figure 4A:
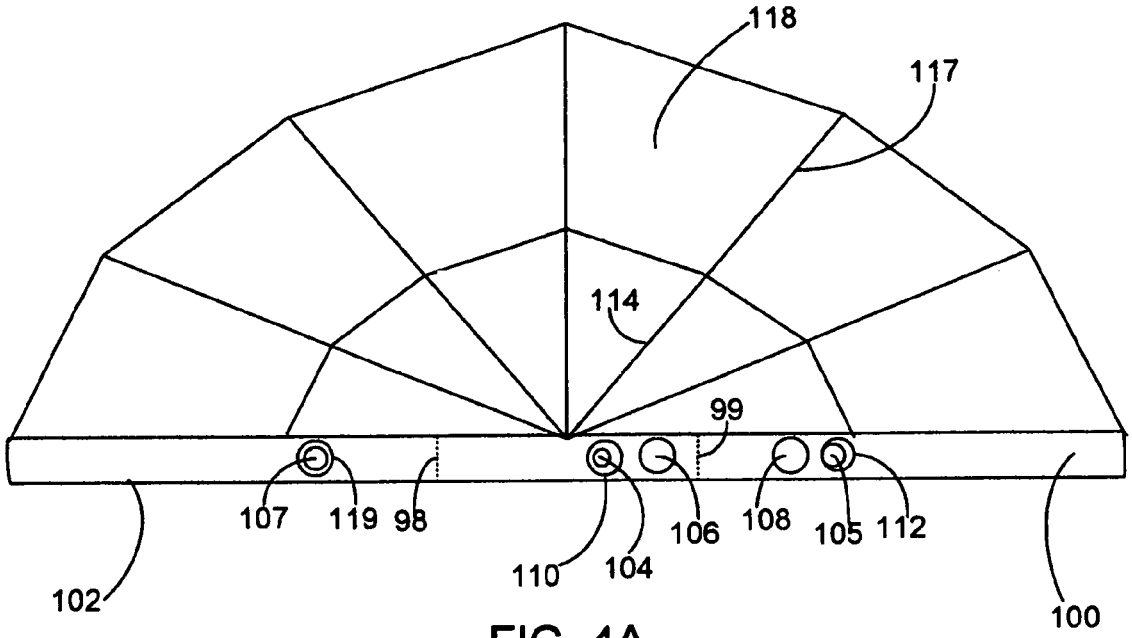
FIG. 4A illustrates a fully opened automatic double folding hand fan, in accordance with one embodiment of the invention.

FIG. 4A illustrates a fully opened automatic double folding hand fan, in accordance with one embodiment of the invention. The fan includes a first guard 100 and a second guard 102, a first rivet 105 with a first spring mechanism 112, and a second rivet 107 with a second spring mechanism 119, activated by a first activation device 108, a third rivet 104 with a third spring mechanism 110, activated by a second activation device 106, a plurality of sticks 114 with corresponding ribs 117 physically supporting a plurality of leaves 118. Guard end 98 indicates the end of guard 100, and guard end 99 indicates the end of guard 102. The guard ends 98 and 99 overlap each other when the fan is opened. This stage of the opening was achieved by activating activation device 106.

Figure 4B:
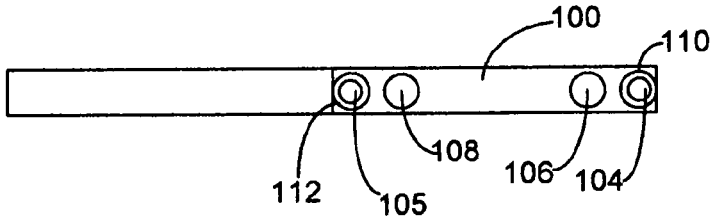
FIG. 4B illustrates a partially opened automatic double folding hand fan, in accordance with one embodiment of the invention.

FIG. 4B illustrates a partially opened automatic double folding hand fan, in accordance with one embodiment of the invention. This view of the fan shows only the first guard 100, a first rivet 105 with a first spring mechanism 112 activated by a first activation device 108, a third rivet 104 with a third spring mechanism 110, activated by a second activation device 106. This stage of the opening was achieved by activating the first activation device 108, which unfolds the two halves of guard 100 and guard 102 (not shown).

Figure 4C:
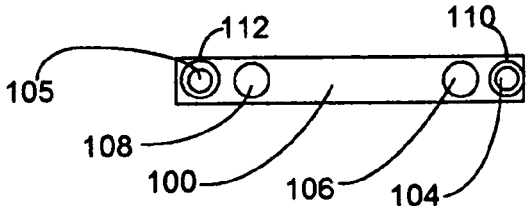
FIG. 4C illustrates a closed automatic double folding hand fan, in accordance with one embodiment of the invention.

FIG. 4C illustrates a closed automatic double folding hand fan, in accordance with one embodiment of the invention. This view of the fan shows only the first half of the first guard 100, a first rivet 105 with the a first spring mechanism 112 activated by a first activation device 108, a third rivet 104 with a third spring mechanism 110, activated by a second activation device 106.

Figure 5A:
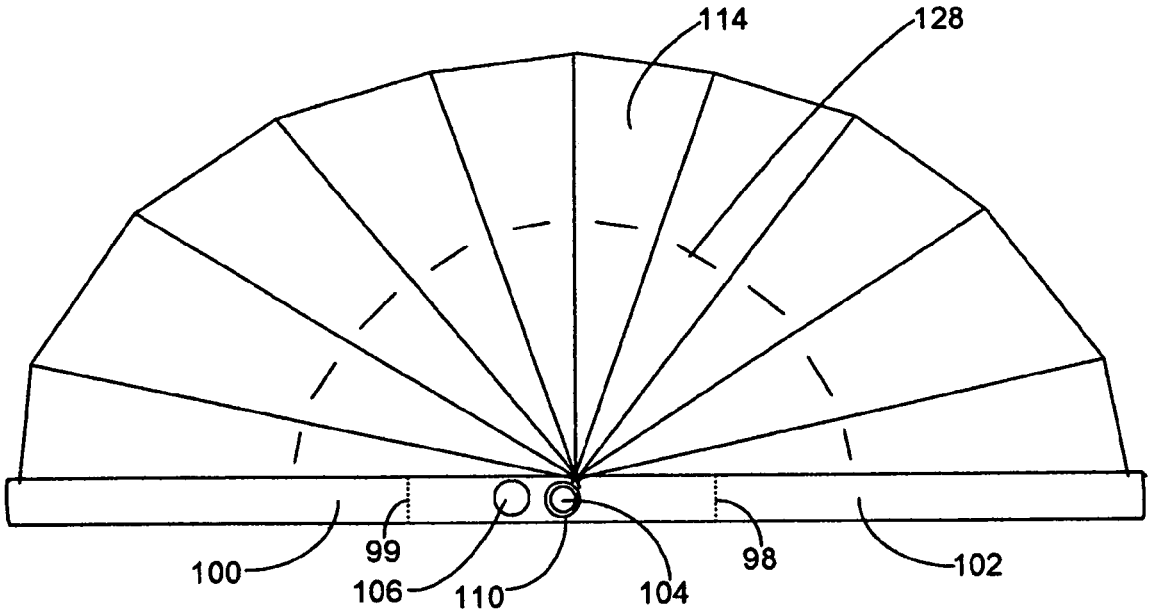
FIG. 5A illustrates a fully opened automatic interlocking hand fan, in accordance with one embodiment of the invention.

FIG. 5A illustrates a fully opened automatic interlocking hand fan, in accordance with one embodiment of the invention. The fan includes a first guard 100 and a second guard 102, a rivet 104, a spring mechanism 110, an activation device 106, such as a bead, button, or stud, which also expands the spacing between a plurality of sticks 114 which also act as the leaves of the fan. Guard end 98 indicates the end of guard 100, and guard end 99 indicates the end of guard 102. The guard ends 98 and 99 overlap each other when the fan is opened. The sticks 114 are controlled by engagements 128, which permit the sticks 114 to be locked in an open position. Alternatively, the activation of the activation device 106 also expands the spacing between the sticks 114 and allows the sticks 114 to slide over each other to close the fan.

Figure 5B:
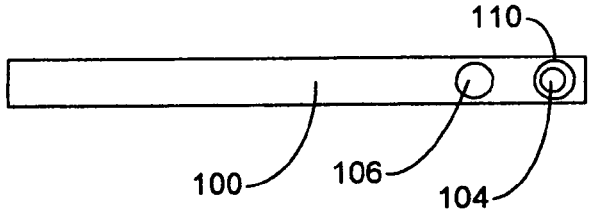
FIG. 5B illustrates a closed automatic interlocking hand fan, in accordance with one embodiment of the invention.

FIG. 5B illustrates a closed automatic interlocking hand fan, in accordance with one embodiment of the invention. This view of the fan only shows the first guard 100, a rivet 104, a spring mechanism 110, and the activation device 106.

Figure 6A:
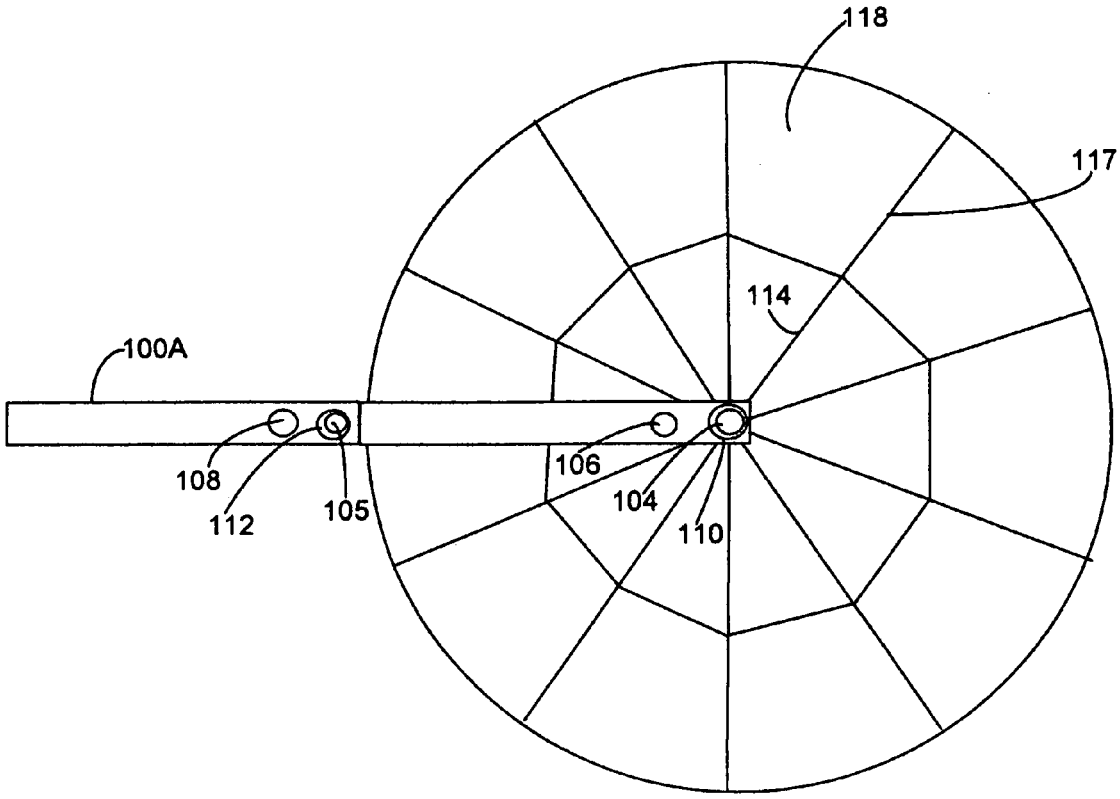
FIG. 6A illustrates a side view of a fully opened automatic double folding circular hand fan, in accordance with one embodiment of the invention.

FIG. 6A illustrates a side view of a fully opened automatic double folding circular hand fan, in accordance with one embodiment of the invention. This substantially circular fan includes a first guard 100 and a second guard 102, a plurality of sticks 114 with corresponding ribs 117 physically supporting a plurality of leaves 118. This stage of the opening was achieved by activating activation device 106 and rivet 104. In one embodiment of the invention, the sticks 114, the leaves 118, and the ribs 117 would fit in half of a guard when the fan is completed folded. The first half guard opens to be the handle, using activation device 108 shown in FIG. 6B; when closed the first half guard protects the fan. The second half guard opens the fan leaves 118 using activation device 106.

Figure 6B:
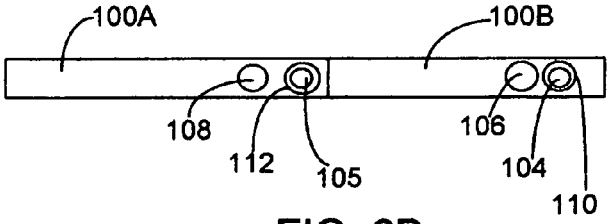
FIG. 6B illustrates a side view of a partially opened automatic double folding circular hand fan, in accordance with one embodiment of the invention.

FIG. 6B illustrates a side view of a partially opened automatic double folding circular hand fan, in accordance with one embodiment of the invention. The fan includes a first guard 100 and a second guard (not shown), a first rivet 105 with a first spring mechanism 112 activated by a first activation device 108, and a second rivet 104 with a second spring mechanism 110, activated by a second activation device 106. This stage of the opening, with a full-length first guard 100 and second guard (not shown), was achieved by activating activation device 105.

Figure 6C:
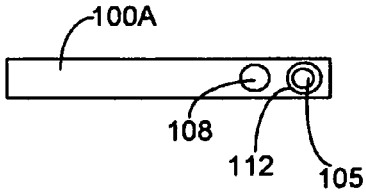
FIG. 6C illustrates a side view of a closed automatic double folding circular hand fan, in accordance with one embodiment of the invention.

FIG. 6C illustrates a side view of a closed automatic double folding circular hand fan, in accordance with one embodiment of the invention. This view of the fan shows only the first half of the first guard 100, a first rivet 105 with a first spring mechanism 112 activated by a first activation device 108.

Figure 6D:
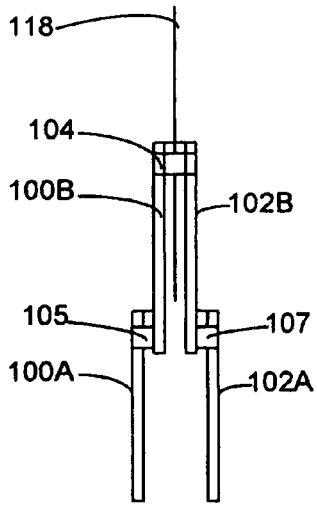
FIG. 6D illustrates an edge view of an open automatic double folding circular hand fan, in accordance with one embodiment of the invention.

FIG. 6D illustrates an edge view of an open automatic double folding circular hand fan, in accordance with one embodiment of the invention. This view of the fan shows an edge view of the substantially planar material 118, the first half 100A of the first guard 100, the first half 102A of the second guard 102, a first rivet 105, the second half 100B of the first guard 100, a second rivet 104, and a third rivet 107 on the second half 102B of the second guard 102.

Figure 7A:
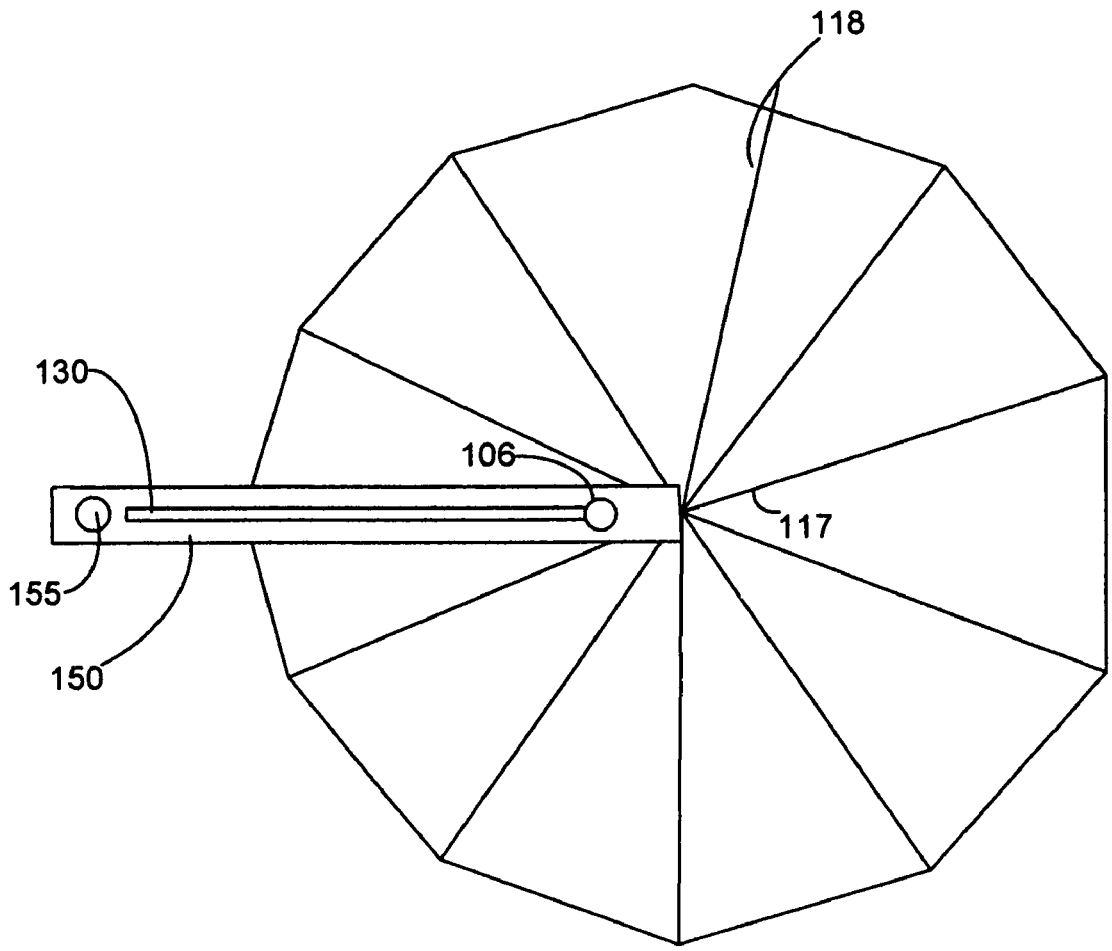
FIG. 7A illustrates a fully opened automatic encased sliding hand fan, in accordance with one embodiment of the invention.

FIG. 7A illustrates a fully opened automatic encased sliding hand fan, in accordance with one embodiment of the invention. This fan includes a handle 150, an automatic activation device 155 to activate a spring (not shown), and a manual activation device 106, a plurality of ribs 117 supporting a substantially planar material 118. This stage of the opening was achieved by activating the automatic activation device 155, or by manually sliding the activation device 106, which could manually be moved to slide in groove 130 towards the open end 156 of the handle 150.

Figure 7B:
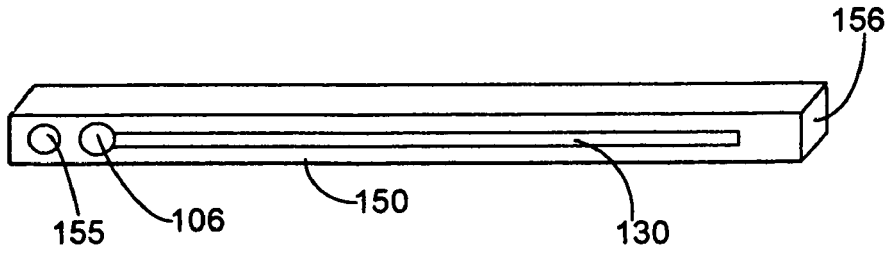
FIG. 7B illustrates a perspective view of a closed automatic encased sliding hand fan, in accordance with one embodiment of the invention.

FIG. 7B illustrates a perspective view of a closed automatic encased sliding hand fan, in accordance with one embodiment of the invention. This view of the fan shows the handle 150, which includes the groove 130, an automatic activation device 155, the manual activation device 106 in the closed position on groove 130, and the open end 156 of the handle 150.

Figure 8:
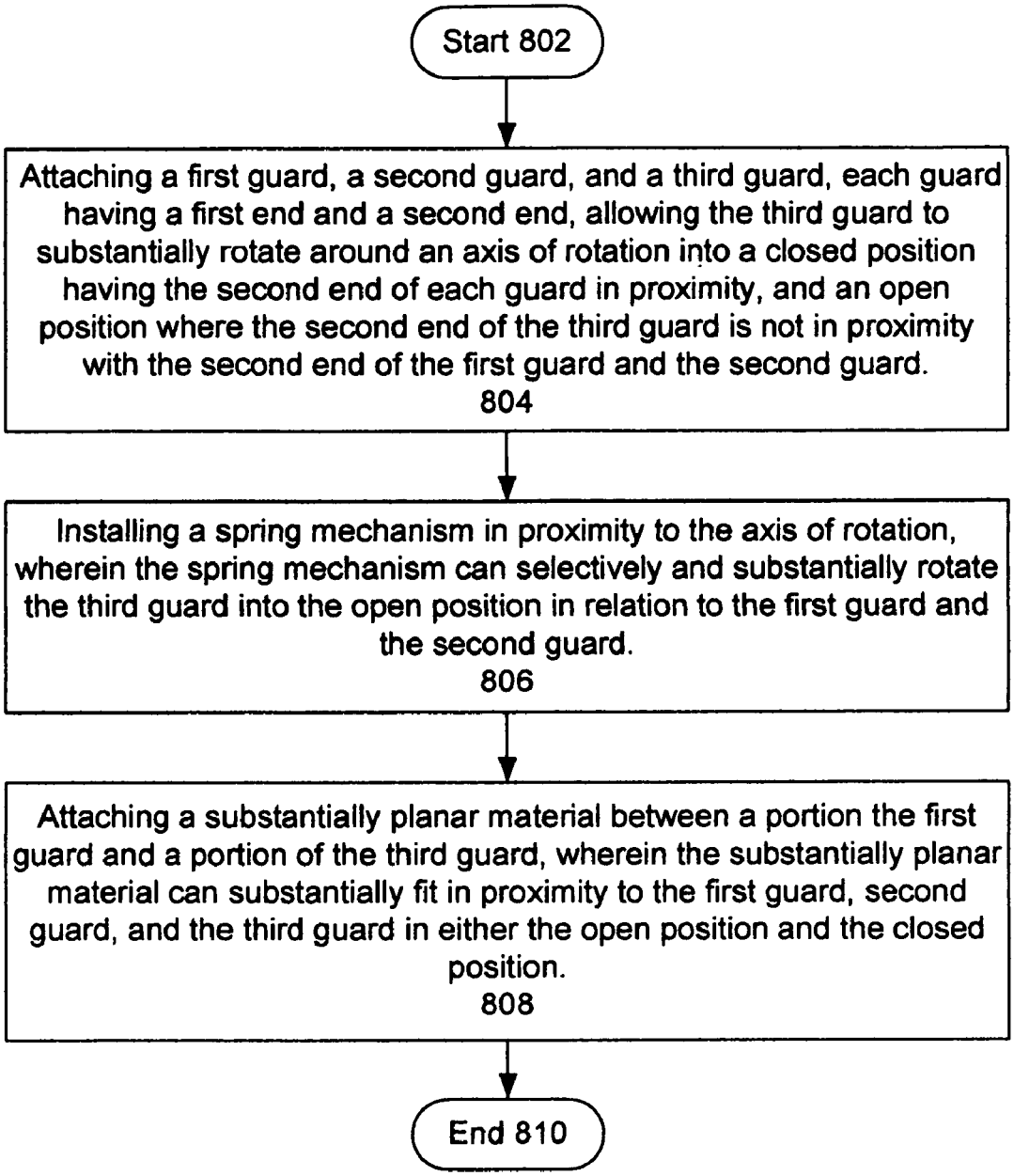
FIG. 8 illustrates a flowchart to make an automatic compact hand fan, in accordance with one embodiment of the invention.

FIG. 8 illustrates a flowchart to make an automatic compact hand fan, in accordance with one embodiment of the invention. The method starts in operation 802. Operation 804 is next and includes attaching a first guard, a second guard, and a third guard, each guard having a first end and a second end, substantially at the first end of the first guard, the second guard, and the third guard, allowing the first guard, the second guard, and the third guard to substantially rotate around an axis of rotation into a closed position, where the second end of the first guard, the second guard, and the third guard are in proximity, and an open position, where the second end of the first guard and the second guard are in proximity, and the second end of the third guard is not in proximity. Operation 806 is next and includes installing a spring mechanism in proximity to the axis of rotation, wherein the spring mechanism can selectively and substantially rotate the third guard into the open position in relation to the first guard and the second guard. Operation 808 is next and includes attaching a substantially planar material between a portion of the first guard and a portion of the third guard, wherein the substantially planar material can substantially fit between the first guard and second guard, and the third guard, in either the open position and the closed position. The method ends in operation 810.

Figure 9:
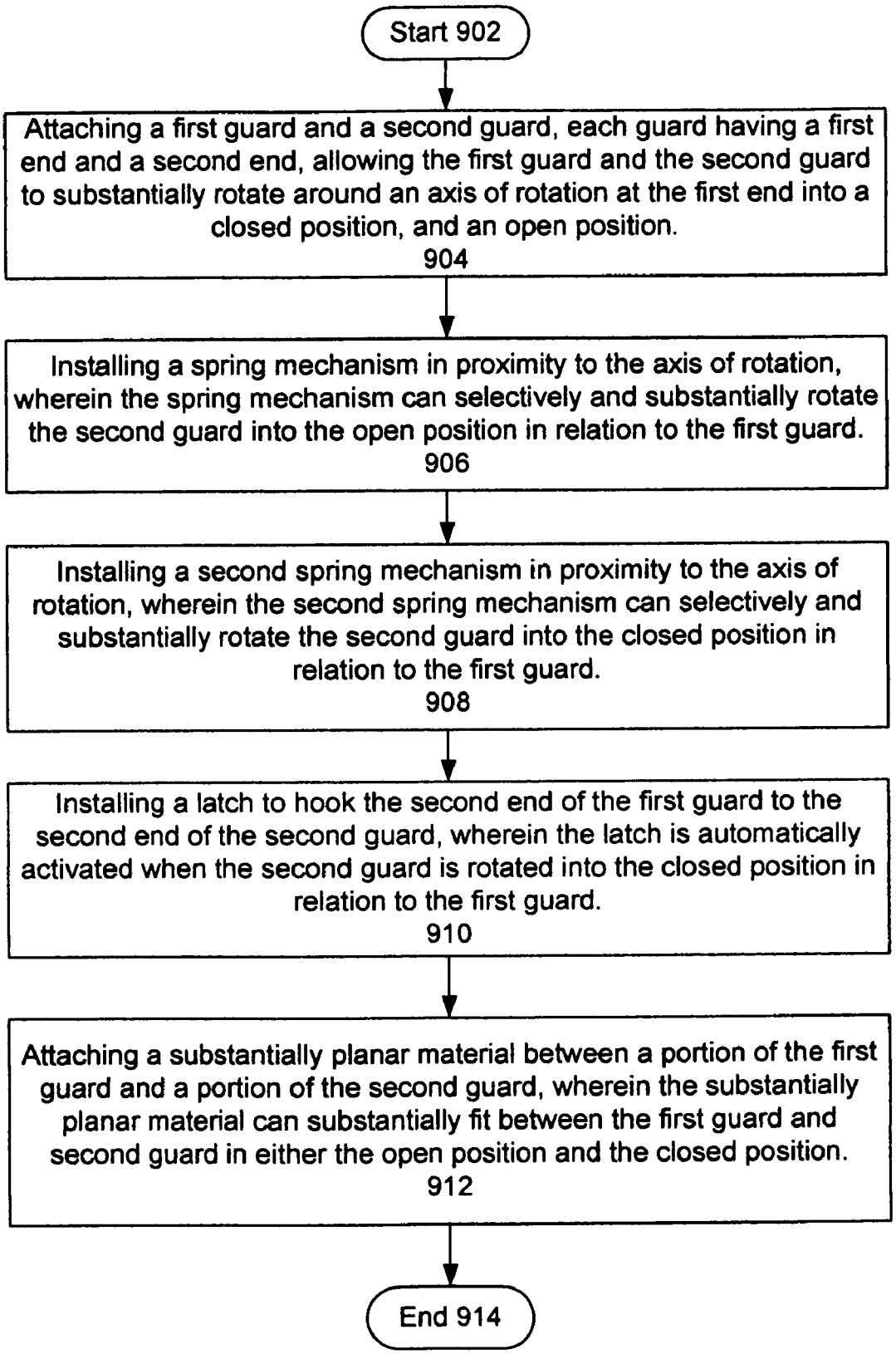
FIG. 9 illustrates a flowchart to make an automatic standard hand fan with an automatic latch, in accordance with one embodiment of the invention.

FIG. 9 illustrates a flowchart to make an automatic standard hand fan with an automatic latch, in accordance with one embodiment of the invention. The method starts in operation 902. Operation 904 is next and includes attaching a first guard, having a first end and a second end, and a second guard, having a first end and a second end, substantially at the first end of the first guard and the first end of the second guard, allowing the first guard and the second guard to substantially rotate around an axis of rotation into a closed position, where the second end of the first guard and the second end of the second guard are in proximity, and an open position, where the second end of the first guard and the second end of the second guard are maximally separated, and the first guard and the second guard are substantially open. Operation 906 is next and includes installing a spring mechanism in proximity to the axis of rotation, wherein the spring mechanism can selectively and substantially rotate the second guard into the open position in relation to the first guard, wherein the spring mechanism can be selectively activated by an operator to achieve the open position. Operation 908 is next and includes installing a second spring mechanism in proximity to the axis of rotation, wherein the second spring mechanism can selectively and substantially rotate the second guard into the closed position in relation to the first guard, wherein the second spring mechanism can be selectively activated by an operator to achieve the closed position. Operation 910 is next and includes installing a latch to hook the second end of the first guard to the second end of the second guard, wherein the latch is automatically activated when the second guard is rotated into the closed position in relation to the first guard. Operation 912 is next and includes attaching a substantially planar material between a portion of the first guard and a portion of the second guard, wherein the substantially planar material can substantially fit between the first guard and second guard in either the open position and the closed position. The method ends in operation 914.

Figure 10:
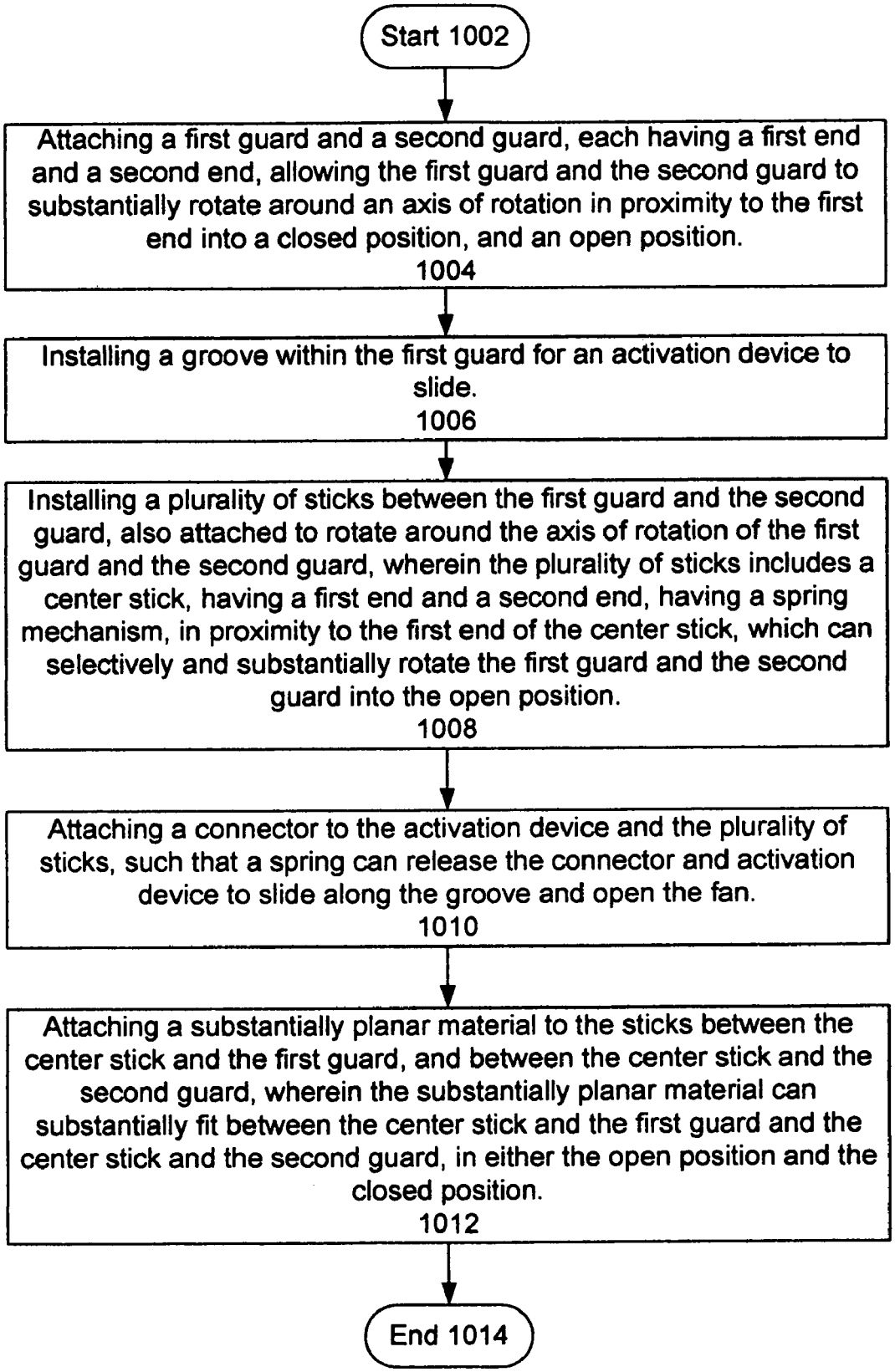
FIG. 10 illustrates a flowchart to make an automatic sliding hand fan, in accordance with one embodiment of the invention.

FIG. 10 illustrates a flowchart to make an automatic sliding hand fan, in accordance with one embodiment of the invention. The method starts in operation 1002. Operation 1004 is next and includes attaching a first guard, having a first end and a second end, and a second guard, having a first end and a second end, substantially at the first end of the first guard and the first end of the second guard, allowing the first guard and the second guard to substantially rotate around an axis of rotation into a closed position, where the second end of the first guard and the second end of the second guard are in proximity, and an open position, where the second end of the first guard and the second end of the second guard are maximally separated, and the first guard and the second guard are substantially open. Operation 1006 is next and includes installing a groove with the first guard for an activation device to slide. Operation 1008 is next and includes installing a plurality of sticks between the first guard and the second guard, also attached to rotate around the axis of rotation of the first guard and the second guard, wherein the plurality of sticks includes a center stick having a spring mechanism which can selectively and substantially rotate the first guard and the second guard into the open position. Operation 1010 is next and includes attaching one more connectors to the activation device and the plurality of sticks, and attaching a spring to the activation device, such that the spring can release the connector(s) and activation device to slide along the groove and open the fan. Operation 1012 is next and includes attaching a substantially planar material on the sticks, between the center stick and the first guard, and between the center stick and the second guard, wherein the substantially planar material can substantially fit between the center stick and the first guard and the center stick and the second guard, in either the open position and the closed position. The method ends in operation 1014.

Figure 11:
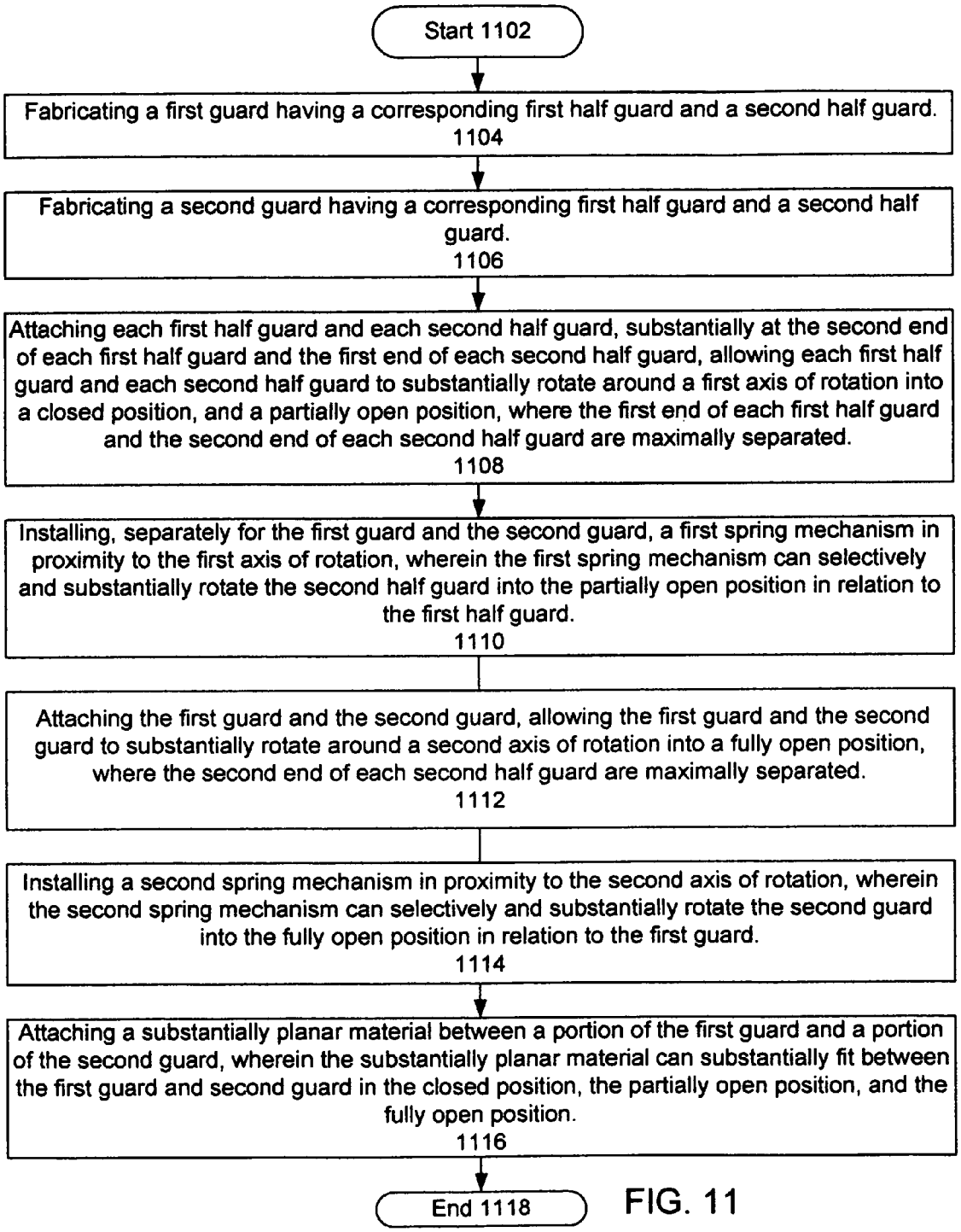
FIG. 11 illustrates a flowchart to make an automatic double folding hand fan, in accordance with one embodiment of the invention.

FIG. 11 illustrates a flowchart to make an automatic double-folding hand fan, in accordance with one embodiment of the invention. The method starts in operation 1102. Operation 1104 is next and includes fabricating a first guard having a corresponding first half guard and a second half guard. Operation 1106 is next and includes fabricating a second guard having a corresponding first half guard and a second half guard. Operation 1108 is next and includes attaching each first half guard, having a first end and a second end, and each second half guard, having a first end and a second end, substantially at the second end of each first half guard and the first end of each second half guard, allowing each first half guard and each second half guard to substantially rotate around a first axis of rotation into a closed position, where the second end of each first half guard and the second end of each second half guard are in proximity, and a partially open position, where the first end of each first half guard and the second end of each second half guard are maximally separated, and each first half guard and each second half guard are substantially open. Operation 1110 is next and includes installing, separately for the first guard and the second guard, a first spring mechanism in proximity to the first axis of rotation, wherein the first spring mechanism can selectively and substantially rotate the second half guard into the open position in relation to the first half guard. Operation 1112 is next and includes attaching the first guard, having a first end and a second end, and the second guard, having a first end and a second end, substantially at the first end of the first guard and the first end of the second guard, allowing the first guard and the second guard to substantially rotate around a second axis of rotation into the open position, where the second end of each second half guard are maximally separated. Operation 1114 is next and includes installing a second spring mechanism in proximity to the second axis of rotation, wherein the second spring mechanism can selectively and substantially rotate the second guard into the fully open position in relation to the first guard. Operation 1116 is next and includes attaching a substantially planar material between a portion of the first guard and a portion of the second guard, wherein the substantially planar material can substantially fit between the first guard and second guard in the closed position, the partially open position, and the fully open position. The method ends in operation 1118.

Figure 12:
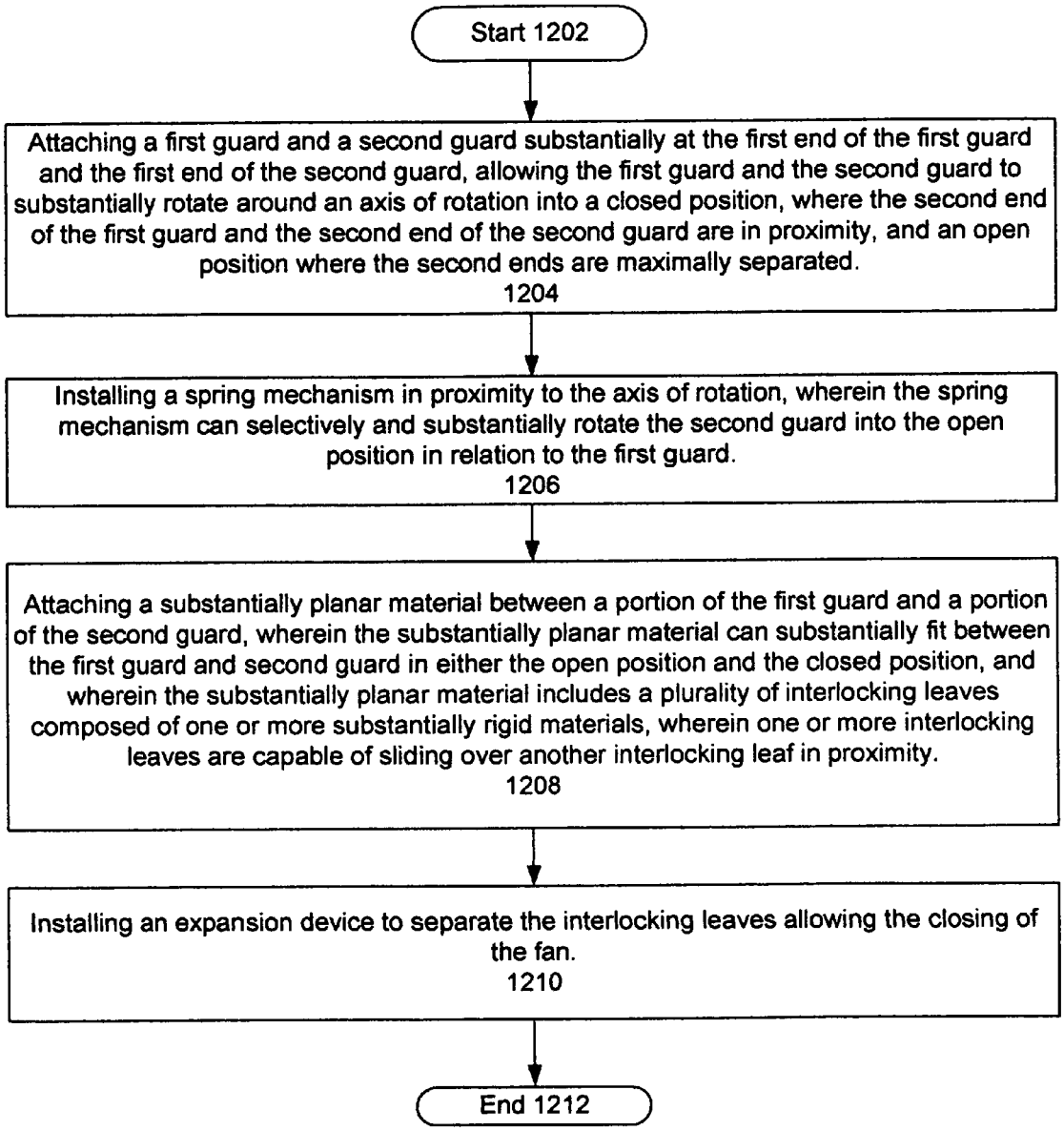
FIG. 12 illustrates a flowchart to make an automatic interlocking hand fan, in accordance with one embodiment of the invention.

FIG. 12 illustrates a flowchart to make an automatic interlocking hand fan, in accordance with one embodiment of the invention. The method starts in operation 1202. Operation 1204 is next and includes attaching a first guard, having a first end and a second end, and a second guard, having a first end and a second end, substantially at the first end of the first guard and the first end of the second guard, allowing the first guard and the second guard to substantially rotate around an axis of rotation into a closed position, where the second end of the first guard and the second end of the second guard are in proximity, and an open position, where the second end of the first guard and the second end of the second guard are maximally separated, and the first guard and the second guard are substantially open. Operation 1206 is next and includes installing a spring mechanism in proximity to the axis of rotation, wherein the spring mechanism can selectively and substantially rotate the second guard into the open position in relation to the first guard, wherein the spring mechanism can be selectively activated by an operator to achieve the open position. Operation 1208 is next and includes attaching a substantially planar material between a portion of the first guard and a portion of the second guard, wherein the substantially planar material can substantially fit between the first guard and second guard in either the open position and the closed position, and wherein the substantially planar material includes a plurality of interlocking leaves composed of one or more substantially rigid materials, wherein one or more interlocking leaves are capable of sliding over interlocking leaves in proximity. Operation 1210 is next and includes installing an expansion device to separate the interlocking leaves allowing the closure of the fan. The method ends in operation 1212.

Figure 13:
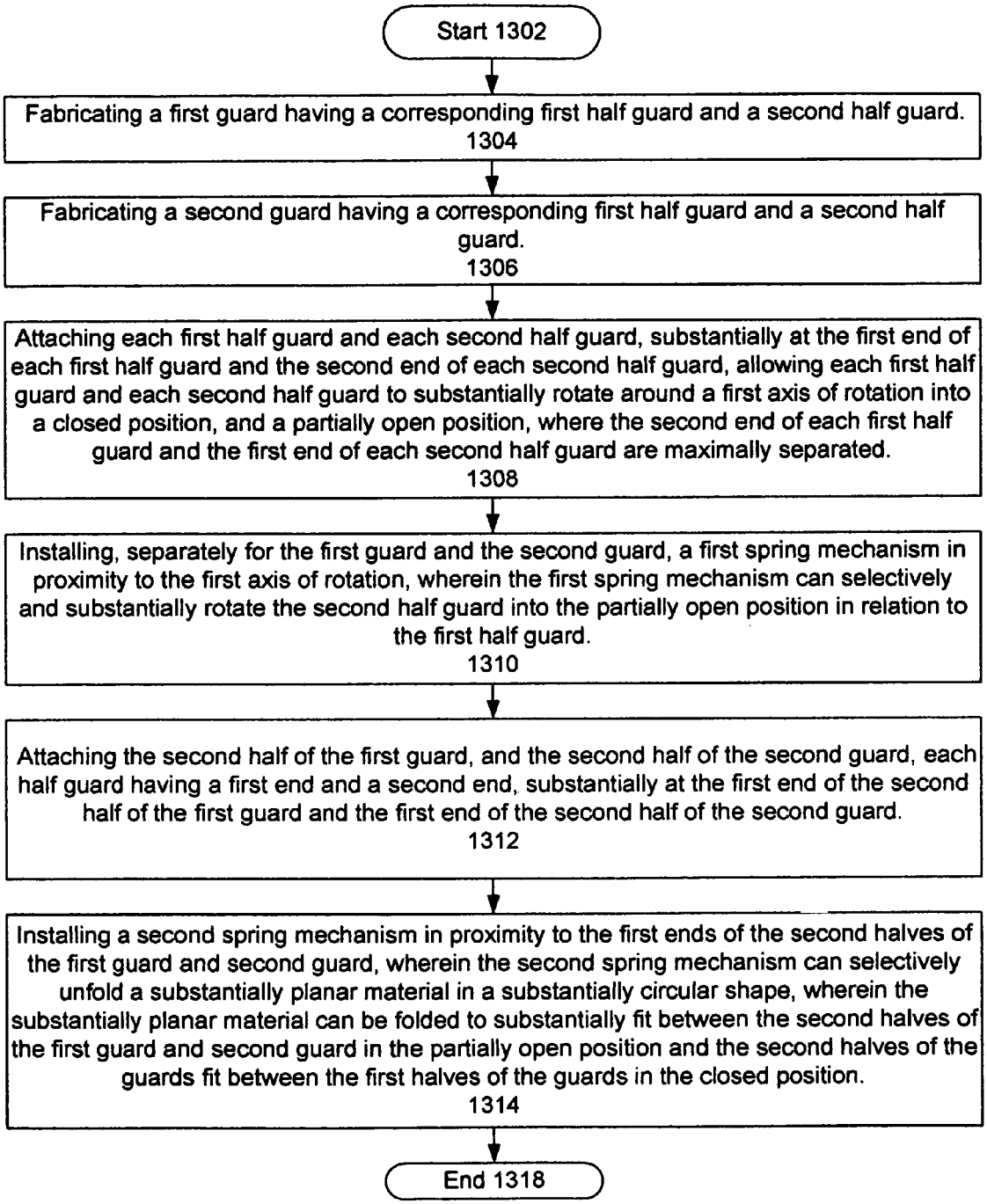
FIG. 13 illustrates a flowchart to make an automatic double folding circular hand fan, in accordance with one embodiment of the invention.

FIG. 13 illustrates a flowchart to make an automatic double folding circular hand fan, in accordance with one embodiment of the invention. The method starts in operation 1302. Operation 1304 is next and includes fabricating a first guard having a corresponding first half guard and a second half guard. Operation 1306 is next and includes fabricating a second guard having a corresponding first half guard and a second half guard. Operation 1308 is next and includes attaching each first half guard, having a first end and a second end, and each second half guard, having a first end and a second end, substantially at the first end of each first half guard and the second end of each second half guard, allowing each first half guard and each second half guard to substantially rotate around a first axis of rotation into a closed position, where the second end of each first half guard and the first end of each second half guard are in proximity, and a partially open position, where the second end of each first half guard and the second end of each second half guard are maximally separated. Operation 1310 is next and includes installing, separately in the first guard and the second guard, a first spring mechanism in proximity to the first axis of rotation, wherein the first spring mechanism can selectively and substantially rotate the second half guard into the partially open position in relation to the first half guard. Operation 1312 is next and includes attaching the second half of the first guard, and the second half of the second guard, each half having a first end and a second end, substantially at the first end of the second half of the first guard and the first end the second half of the second guard. Operation 1314 is next and includes installing a second spring mechanism in proximity to the first ends of the second halves of the first guard and the second guard, wherein the second spring mechanism can selectively unfold a substantially planar material in a substantially circular shape, wherein the substantially planar material can be folded to substantially fit between the second halves of the first guard and the second guard in the partially open position, and the second halves of the first and second guards fit substantially between the first halves of the first and second guards in the closed position. The method ends in operation 1318.

Figure 14:
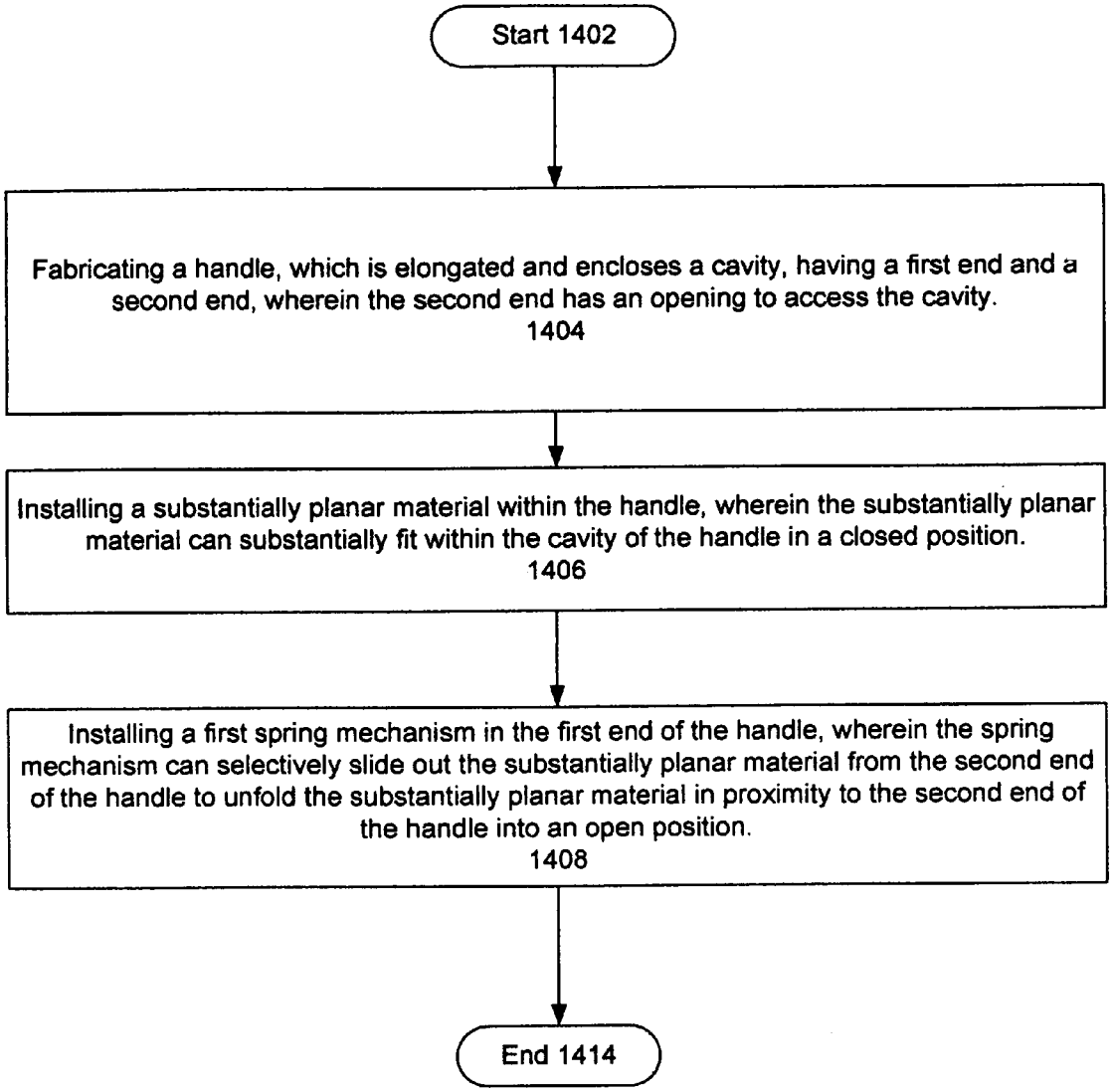
FIG. 14 illustrates a flowchart to make an automatic encased sliding hand fan, in accordance with one embodiment of the invention.

FIG. 14 illustrates a flowchart to make an automatic encased sliding hand fan, in accordance with one embodiment of the invention. The method begins in operation 1402. Operation 1404 is next and includes fabricating a handle, which is elongated and encloses a cavity, wherein the handle has a first end and a second end, wherein the second end of the handle has an opening to access the cavity. Operation 1406 is next and includes installing a substantially planar material within the handle, wherein the substantially planar material can substantially fit within the cavity of the handle in a closed position. Operation 1408 is next and includes installing a first spring mechanism in the handle, wherein the spring mechanism can selectively slide out the substantially planar material from the second end of the handle to unfold the substantially planar material in proximity to the second end of the handle into an open position. The method ends in operation 1414.

Figure 15A:
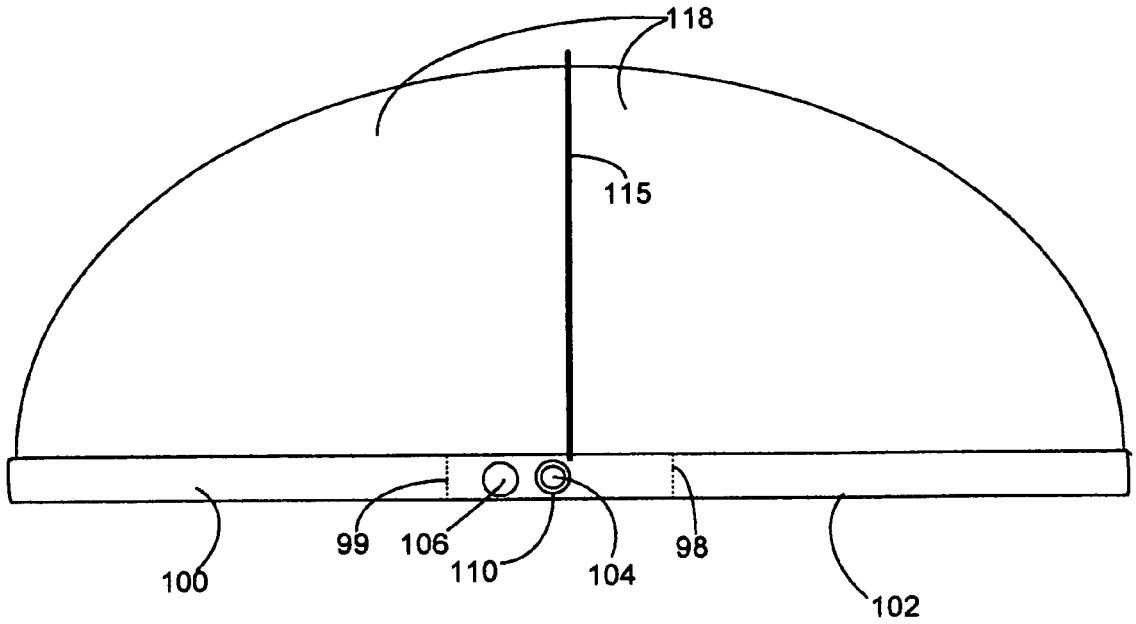
FIG. 15A illustrates a fully opened automatic rolled hand fan, in accordance with one embodiment of the invention.

FIG. 15A illustrates a fully opened automatic rolled hand fan, in accordance with one embodiment of the invention. The fan includes a first guard 100 and a second guard 102, a rivet 104, a spring mechanism 110, an activation device 106, a sturdy and stable center stick 115 attached to a rotational device 140 (shown in FIG. 15C, e.g., a spring or coil) situated and activated with activation device 106. Guard end 98 indicates the end of guard 100, and guard end 99 indicates the end of guard 102. The guard ends 98 and 99 overlap each other when the fan is opened. The substantially planar material 118 is attached to the center stick 115 and is uncoiled in the open position, being also attached to the first guard 100 and second guard 102.

The embodiment shown in FIG. 15A is a fan that will automatically open via a release of an activation device 106 (e.g., bead, button, stud, or an equivalent), unrolling the coiled substantially planar material 118; and will close via the activation device 106 back into a coiled position around the center stick 115 to the closed position to fit between the first guard 100 and the second guard 102. In alternative embodiments, the fan could be closed with a miniature motor to rotate the center stick 115 within and between the guards 100 or 102.

The fan appears as a standard hand fan, except the substantially planar material rolls off of the center stick 115, as guards 100 and 102 rotate away from the center stick 115.

Figure 15B:
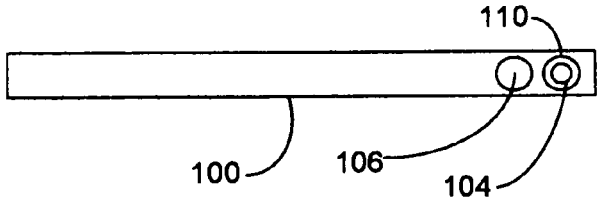
FIG. 15B illustrates a closed automatic rolled hand fan, in accordance with one embodiment of the invention.
Figure 15C:
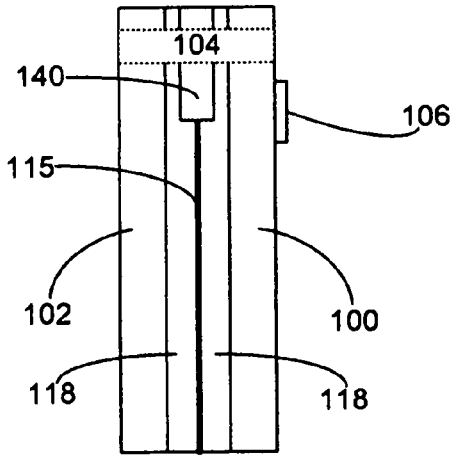
FIG. 15C illustrates an edge view of a closed automatic rolled hand fan, in accordance with one embodiment of the invention.

A spring mechanism (e.g., one or more spring(s) 110), coupled to the center stick 115, opens the fan when the activation device 106 engages a rotational device 140 (shown in FIG. 15C).

FIG. 15B illustrates a closed automatic rolled hand fan, in accordance with one embodiment of the invention. This view shows the first guard 100, a rivet 104, a spring mechanism 110, and an activation device 106.

FIG. 15C illustrates an edge view of a closed automatic rolled hand fan, in accordance with one embodiment of the invention. This view shows the first guard 100, the second guard 102, a rivet 104, the substantially planar material 118, an activation device 106, and rotational device 140.

Figure 16:
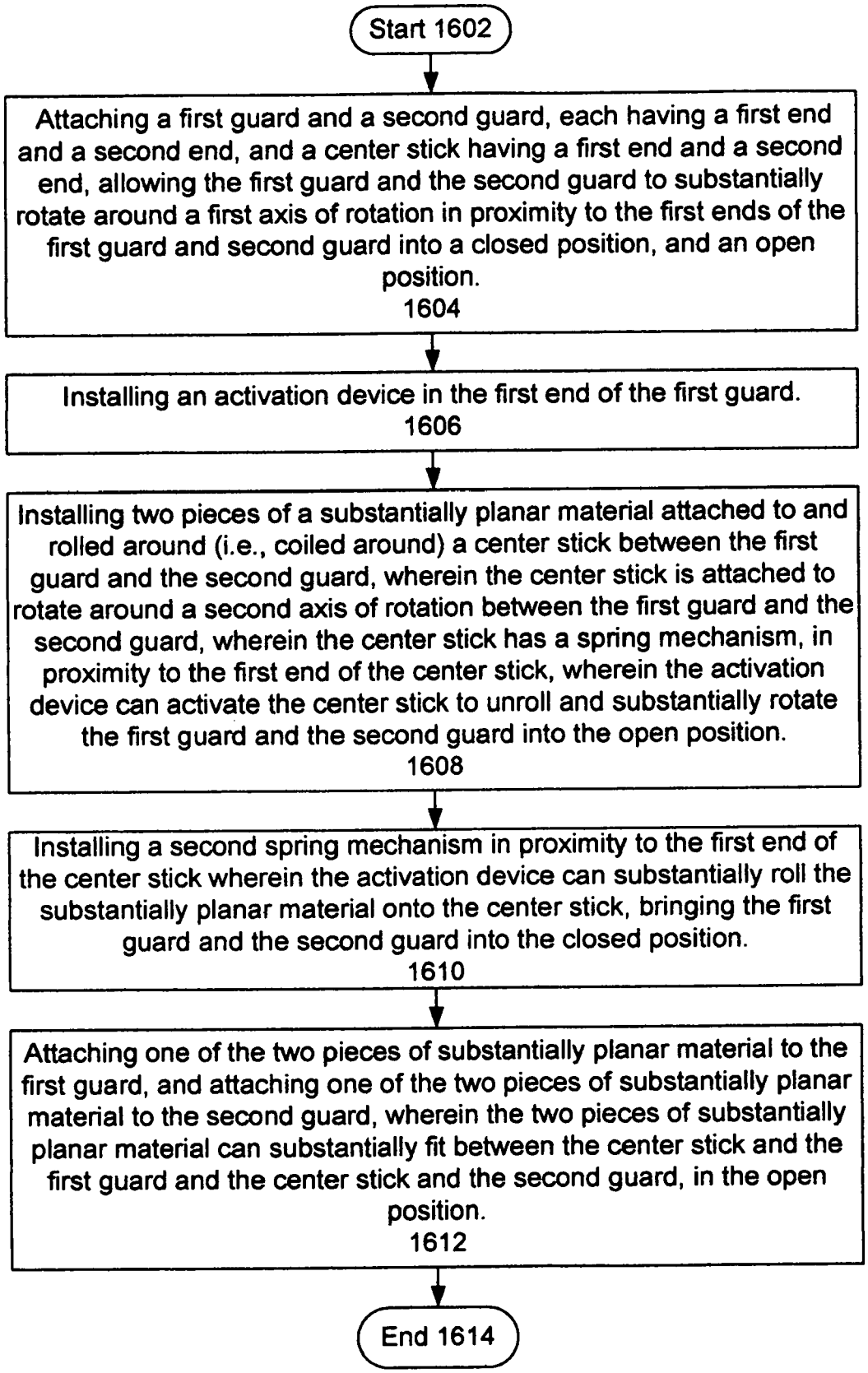
FIG. 16 illustrates a flowchart to make an automatic rolled hand fan, in accordance with one embodiment of the invention.

FIG. 16 illustrates a flowchart to make an automatic rolled hand fan, in accordance with one embodiment of the invention. The method starts in operation 1602. Operation 1604 is next and includes attaching a first guard and a second guard, each having a first end and a second end, and a center stick having a first end and a second end, allowing the first guard and the second guard to substantially rotate around a first axis of rotation in proximity to the first ends of the first guard and second guard into a closed position, and an open position, where the second end of the first guard and the second end of the second guard are maximally separated. Operation 1606 is next and includes installing an activation device on the first guard. Operation 1608 is next and includes installing two pieces of a substantially planar material attached to and rolled around (i.e., coiled around) a center stick between the first guard and the second guard, wherein the center stick is attached to rotate around a second axis of rotation between the first guard and the second guard, wherein the center stick has a spring mechanism, in proximity to the first end of the center stick, wherein the activation device can activate the center stick to unroll and substantially rotate the first guard and the second guard into the open position. Operation 1610 is next and includes installing a second spring mechanism in proximity to the first end of the center stick wherein the activation device can substantially roll the substantially planar material onto the center stick, bringing the first guard and the second guard into the closed position. Operation 1612 is next and includes attaching one of the two pieces of substantially planar material to the first guard, attaching one of the two pieces of substantially planar material to the second guard, wherein the two pieces of substantially planar material can substantially fit between the center stick and the first guard and the center stick and the second guard, in the open position. The method ends in operation 1614.

Other embodiments of the invention are possible. For example, the activation devices shown on the guard of any embodiment of the invention could be placed in other locations on the guards, such as at either end of the guards, or central to the guards. One activation device could both open and close a fan, or one activation device could be dedicated to opening a fan, and a second activation device could be dedicated to closing a fan. Furthermore, any of the embodiments disclosed above could alternatively include a microchip-controlled motor or additional springs to close the hand fan either completely or partially.

The exemplary embodiments described herein are for purposes of illustration and are not intended to be limiting. Therefore, those skilled in the art will recognize that other embodiments could be practiced without departing from the scope and spirit of the claims set forth below.

What is claimed is:

1. A method to make an automatic double-folding hand fan, comprising:

fabricating a first guard having a corresponding first half guard and a second half guard;

fabricating a second guard having a corresponding first half guard and a second half guard;

attaching each first half guard, having a first end and a second end, and each second half guard, having a first end and a second end, substantially at the second end of each first half guard and the first end of each second half guard, allowing each first half guard and each second half guard to substantially rotate around a first axis of rotation into a closed position, where the second end of each first half guard and the second end of each second half guard are in proximity, and a partially open position, where the first end of each first half guard and the second end of each second half guard are maximally separated;

installing, separately for the first guard and the second guard, a first spring mechanism in proximity to the first axis of rotation, wherein the first spring mechanism can selectively and substantially rotate the second half guard into the partially open position in relation to the first half guard;

attaching the first guard, having a first end and a second end, and the second guard, having a first end and a second end, substantially at the first end of the first guard and the second end of the second guard, allowing the first guard and the second guard to substantially rotate around a second axis of rotation into a fully open position, where the second end of the second half of the first guard and the second end of the second guard are maximally separated;

installing a second spring mechanism in proximity to the second axis of rotation, wherein the second spring mechanism can selectively and substantially rotate the second guard into the fully open position in relation to the first guard; and attaching a substantially planar material between a portion of the first guard and a portion of the second guard, wherein the substantially planar material can substantially fit between the first guard and second guard in the closed position, the partially open position, and the fully open position.

2. The method of claim 1, wherein the first spring mechanism can be selectively locked by an operator in a position corresponding to the closed position of the first half guard and the second half guard.

3. The method of claim 1, further comprising:

installing a mechanism which an operator can selectively activate to automatically achieve the partially open position of the first guard and the second guard.

4. The method of claim 1, wherein the substantially planar material includes a plurality of interlocking leaves composed of one or more substantially rigid materials, wherein one or more interlocking leaves are capable of sliding over another interlocking leaf in proximity.

5. The method of claim 1, wherein the substantially planar material includes a foldable fabric supported by a plurality of substantially rigid ribs.

6. An automatic double folding hand fan, comprising:

a first guard having a corresponding first half guard and a second half guard;

a second guard having a corresponding first half guard and a second half guard;

an attachment between each first half guard, having a first end and a second end, and each second half guard, having a first end and a second end, wherein the attachment is substantially at the second end of each first half guard and the first end of each second half guard, allowing each first half guard and each second half guard to substantially rotate around a first axis of rotation into a closed position, where the second end of each first half guard and the second end of each second half guard are in proximity, and rotate into a partially open position, where the first end of each first half guard and the second end of each second half guard are maximally separated;

a first spring mechanism in proximity to the first axis of rotation, installed separately for the first guard and the second guard, wherein the first spring mechanism can selectively and substantially rotate the second half guard into the partially open position in relation to the first half guard;

an attachment of the first guard, having a first end and a second end, and the second guard, having a first end and a second end, substantially at the first end of the first guard, allowing the first guard and the second guard to substantially rotate around a second axis of rotation into the fully open position, where the second end of each second half guard are maximally separated;

a second spring mechanism in proximity to the second axis of rotation, wherein the second spring mechanism can selectively and substantially rotate the second guard into the fully open position in relation to the first guard; and a substantially planar material attached between a portion of the first guard and a portion of the second guard, wherein the substantially planar material can substantially fit between the first guard and second guard in the closed position, the partially open position, and the fully open position.

* * * * *